US005753846A

United States Patent [19]

Koon

[11] Patent Number: 5,753,846

[45] Date of Patent: May 19, 1998

[54] BARREL EXTENDER WITH RECOIL REDUCTION

[75] Inventor: Homer Koon, Denton, Tex.

[73] Assignee: Sigma Research Inc., Carrollton, Tex.

[21] Appl. No.: 928,904

[22] Filed: Sep. 12, 1997

Related U.S. Application Data

[63] Continuation of Ser. No. 752,322, Nov. 19, 1996, abandoned.

[51] Int. Cl.[6] ..... F41A 21/28

[52] U.S. Cl. ..... 89/14.3; 42/75.02

[58] Field of Search ..... 42/1.06, 77, 76.01, 42/75.02; 89/14.05, 14.2, 14.3, 14.4

[56] References Cited

U.S. PATENT DOCUMENTS

| | | | |
|---|---|---|---|
| 812,140 | 2/1906 | Kent | 89/14.3 |
| 2,128,936 | 9/1938 | Green | 89/14.3 |
| 3,667,570 | 6/1972 | Werbell, III | 89/14.4 |
| 3,710,679 | 1/1973 | Werbell, III | 89/14.4 |
| 3,776,093 | 12/1973 | Leverance et al. | 89/14.4 |
| 4,307,652 | 12/1981 | Witt et al. | 89/14.3 |
| 4,907,488 | 3/1990 | Seberger | 89/14.4 |
| 5,020,416 | 6/1991 | Tripp | 89/14.3 |
| 5,063,827 | 11/1991 | Williamson | 89/14.3 |
| 5,305,678 | 4/1994 | Talbot et al. | 89/14.3 |
| 5,320,022 | 6/1994 | Kimbro et al. | 89/14.3 |
| 5,357,842 | 10/1994 | Reynolds | 89/14.3 |
| 5,415,073 | 5/1995 | Ciluffo | 89/14.3 |

FOREIGN PATENT DOCUMENTS

| | | | |
|---|---|---|---|
| 70612 | 1/1983 | European Pat. Off. | 89/14.3 |
| 624267 | 7/1927 | France | 89/14.3 |
| 864735 | 5/1941 | France | 89/14.4 |
| 1487493 | 5/1967 | France | 89/14.3 |
| 405318 | 12/1945 | Italy | 89/14.3 |
| 223326 | 11/1942 | Switzerland | 89/14.3 |
| 161457 | 4/1921 | United Kingdom | 89/14.3 |

*Primary Examiner*—Stephen M. Johnson
*Attorney, Agent, or Firm*—Mark W. Handley; Gregory M. Howison

[57] ABSTRACT

A ballistic weapon is disclosed having a barrel with a forward end to which a barrel extender is secured. The barrel extender includes a cylindrical outer body portion, a forward ring-like portion and a rearward wall portion, which together define a forward chamber in communication with the bore of the barrel of the weapon. A plurality of apertures extend through the rearward wall portion and are angularly spaced equidistances apart around a central longitudinal axis of the bore of the barrel. The apertures define central axes which are substantially parallel to the central longitudinal axis of the bore of the barrel. The apertures connect the forward chamber to an interior annular space extending between the exterior of the barrel and a perforated shroud extending exteriorly around the barrel. The apertures pass hot gases created by ignition of the explosive or propellant charge from the forward chamber in a rearward direction, along paths which are substantially parallel to the central longitudinal axis of the barrel of the weapon. The perforated shroud provides a shield for preventing blow-back of the hot gases expulsed through the apertures from reaching the person firing the weapon, and to allow the gases expulsed through the apertures to be dissipated and pass exteriorly of the weapon.

18 Claims, 2 Drawing Sheets

BARREL EXTENDER WITH RECOIL REDUCTION

CROSS REFERENCE TO RELATED APPLICATIONS

This application is a continuation of U.S. patent application Ser. No. 08/752,322, filed Nov. 19, 1996 (Att. Dkt. No. SGMA-23,885 now abandoned), entitled "Barrel Extender With Recoil Reduction."

TECHNICAL FIELD OF THE INVENTION

The present invention relates in general to ballistic weapon systems and, in particular, to a barrel extender having recoil reduction for mounting to the muzzle of a barrel of a ballistic weapon.

BACKGROUND OF THE INVENTION

Ballistic weapons, such as firearms, typically utilize explosive or propellant charges for igniting to propel ballistic projectiles through the barrels of the weapons. Ignition of the explosive or propellant charges, and propulsion of the ballistic projectiles from within the weapons cause a phenomenon known as recoil, which causes the weapons to move in an opposite direction from the direction in which the projectiles travel. Recoil of the weapons often results in movement of the forward ends of the barrels, causing inaccuracies in aiming ballistic weapons which are operated in rapid-fire modes.

Various types of prior art devices have been devised for preventing recoil. Such devices generally tend to cause explosive gases created by ignition of the explosive or propellant charges to travel through holes, which extend in directions which are transverse to a central longitudinal axis of the bores of the barrels of the weapons. Gases are often allowed to escape from ports cut into outer walls of tubular members, which are either attached to or form a part of barrels of a prior art ballistic weapons. However, gases allowed to escape from within the barrel, which are directed outward, in a transverse direction to the direction travel of the projectiles, reduce the propulsive forces imparted to the projectiles. Reductions in the propulsive forces imparted to the projectiles require longer barrels and a greater amount of explosive charge, which result in desired projectile velocities.

SUMMARY OF THE INVENTION

The present invention disclosed and claimed herein comprises a ballistic weapon having a barrel with a forward end to which a barrel extender is secured. The barrel extender includes a cylindrical outer body portion, a forward ring-like portion and a rearward wall portion, which together define a forward chamber in communication with the bore of the barrel of the weapon. A plurality of apertures extend through the rearward wall portion and are angularly spaced equidistances apart around a central longitudinal axis of the bore of the barrel. The apertures define central axes which are substantially parallel to the central longitudinal axis of the bore of the barrel. The apertures connect the forward chamber to an interior annular space extending between the exterior of the barrel and a perforated shroud extending exteriorly around the barrel. The apertures pass hot gases, created by ignition of the explosive or propellant charge, from the forward chamber in a rearward direction, along paths which are substantially parallel to the central longitudinal axis of the barrel of the weapon. The perforated shroud provides a shield for preventing blow-back of the hot gases expulsed through the apertures from reaching the person firing the weapon, and allows the gases expulsed through the apertures to be dissipated and pass exteriorly of the weapon.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
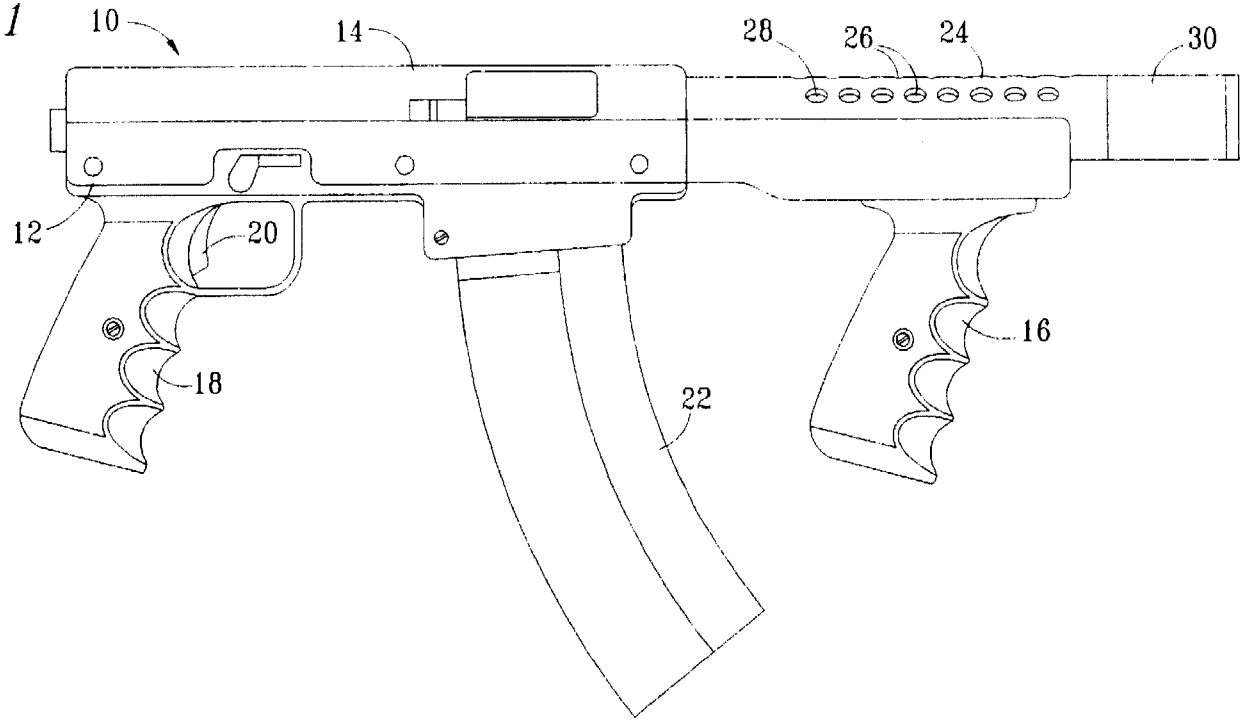
FIG. 1 illustrates a side-elevational view of a ballistic weapon of the preferred embodiment of the present invention.

Referring now to FIG. 1, there is illustrated a side elevational view of a ballistic weapon 10 of the preferred embodiment of the present invention. The weapon 10 includes a frame 12 and a housing 14, which is mounted to the frame 12. The weapon 10 also includes a forward grip 16 and a rearward grip 18. A trigger 20 is disposed in the rearward grip 18. A magazine clip 22 extends from beneath the frame 12 of the weapon 10. A barrel shroud 24 is mounted forward of housing 14, and has a plurality of perforations 26 extending therethrough. The perforations 26 preferably extend transverse to the length of a barrel 28. The barrel shroud 24 extends around the exterior of the barrel 28. A barrel extender 30 is mounted to the forward end of the barrel 28, and may be considered as part of the barrel 28.

Figure 2:
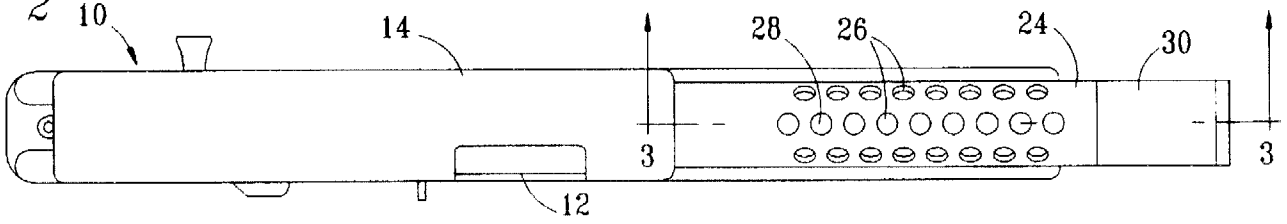
FIG. 2 illustrates a top view of the ballistic weapon of the preferred embodiment of the present invention.

Referring now to FIG. 2, there is illustrated a top view of the weapon 10. The perforations 26 can be seen extending through the barrel shroud 24 in a direction which is transverse to the length of the barrel 28. The barrel extender 30 is included on the forward end of the barrel 28.

Figure 3:
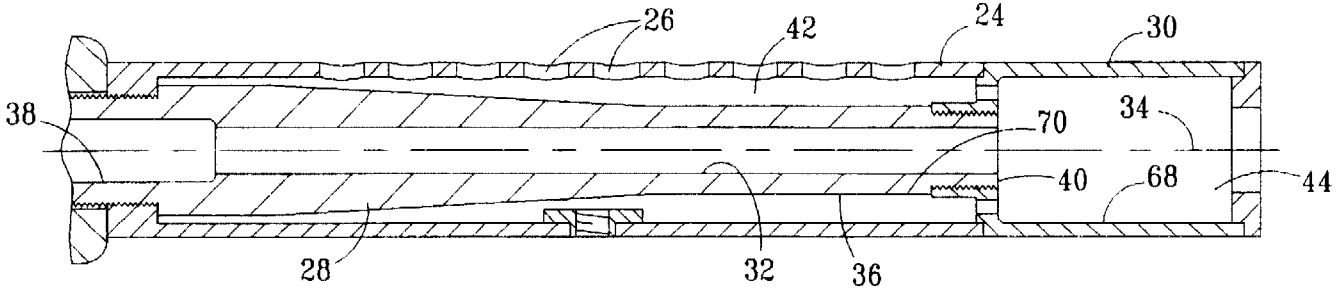
FIG. 3 illustrates a sectional view of the ballistic weapon of FIG. 2, taken along section line 3—3.

Referring now to FIG. 3, there is illustrated a longitudinal section view of the forward end of the weapon 10, taken along section line 3—3 of FIG. 2. A bore 32 of the barrel 28 extends longitudinally through the barrel 28 with a central longitudinal axis 34. The bore 32 preferably has rifling grooves formed therein. The barrel 28 has a tapered exterior 36 which extends from a rearward region proximate to a cartridge chamber 38 to a muzzle 40 of the barrel 28. The exterior 36 of the barrel 28 tapers to a smaller diameter as it extends from the region proximate to the cartridge chamber 38 to the muzzle 40.

A rearward annular chamber 42 is defined between the exterior surface 36 of the barrel 28 and the barrel shroud 24. The rearward annular chamber has a cross-sectional area which tapers to a smaller sized annular cross-sectional area in a rearward direction due to the taper of the barrel 28. The barrel extender 30 defines a forward chamber 44.

Figure 4:
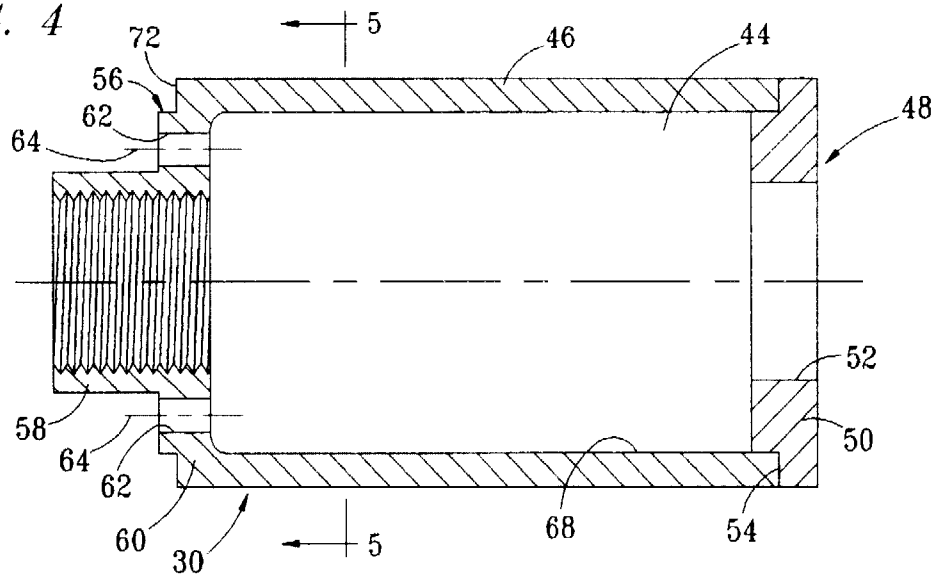
FIG. 4 illustrates an enlarged view of the sectional view of the barrel extender of the forward end of the barrel of the ballistic weapon of FIG. 3.

Referring now to FIG. 4, there is illustrated an enlarged view of the sectional view of the barrel extender 30 of FIG. 3. The barrel extender 30 includes a cylindrical outer body portion 46 and a forward ring-like cap portion 48. The forward ring-like portion 48 defines a forward wall 50, having a central hole 52 which extends therethrough. A shoulder 54 is formed into the outermost portion of the forward wall 50 for exteriorly receiving the cylindrical outer body portion 46.

The barrel extender 30 further includes a rearward portion 56, which is preferably integrally formed with the cylindrical outer body portion 46. The rearward portion 56 includes a cylindrical connector 58 which has a threaded interior surface for coupling to a threaded exterior surface of the muzzle 40 of the barrel 28. The cylindrical connector 58 is also integrally formed with the rearward portion 56 and the cylindrical outer body portion 46, which are all preferably formed as a single casting. A rearward annular wall 60 extends between the cylindrical connector 58 and the cylindrical outer body portion 46. Apertures 62 extend transversely through the rearward wall 60 with central axes 64, which are preferably parallel to the central longitudinal axis 34 of the bore 32 of the barrel 28.

Figure 5:
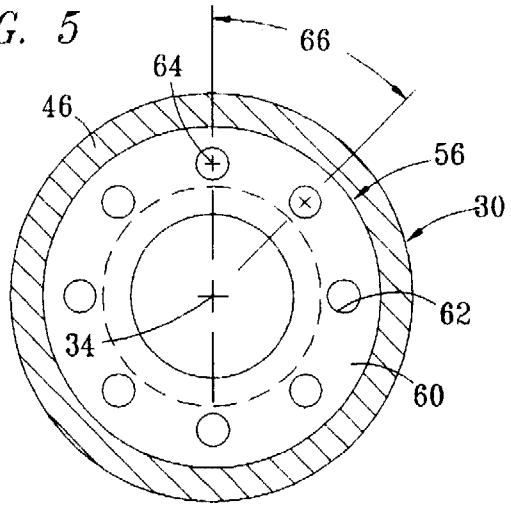
FIG. 5 illustrates a sectional view of the barrel extender of FIG. 4, taken along section line 5—5.

Referring now to FIG. 5, there is illustrated a cross-sectional view of the barrel extender 30, taken along section line 5—5 of FIG. 4. Preferably, there are eight of the apertures 62 which are angularly spaced equidistances apart around the central longitudinal axis 34 of the bore 32, in a circumferentially aligned pattern in which they are angularly spaced apart at angle 66, measuring approximately 45.0 degrees. Preferably, the apertures 62 are angularly spaced apart equidistances all the way around central longitudinal axis 34, for 360.0 degrees.

Referring now to FIGS. 3 and 4, the interior surface 68 of the cylindrical outer body portion 46 of the barrel extender 30 preferably defines an interior diameter of the forward chamber 44. The interior diameter of surface 68 is significantly larger than the outside diameter of the forward portion 70 of the tapered exterior surface 36 of the barrel 28, such that the apertures 62 will extend rearwardly from the forward chamber 44 and into the rearward annular chamber 42. The rearward annular chamber 42 is disposed exteriorly about the barrel 28 and within the perforated barrel shroud 24. The cross-sectional area of the forward chamber 44 is also significantly larger than the cross-sectional area of the bore 32 of the barrel 28. A shoulder 72 circumferentially extends into the exterior of the rearward portion 56 of the barrel extender 30 for exteriorly receiving the barrel shroud 24.

In operation, a cartridge will be placed within chamber 38 and then fired. Preferably, the weapon 10 is operable in a rapid-fire mode, such as an automatic or semi-automatic modes. The explosive or propellant charge within the cartridge will be ignited, and then hot gases will be created, which propel a projectile from within the cartridge and through the bore 32 of the barrel 28 along the central longitudinal axis 34. Some of the gases will pass from the bore 32 into the forward chamber 44, and then rearwardly through the apertures 62. The hot gases will be expulsed through the eight apertures 62 in an equidistant pattern, since the apertures are angularly spaced apart equal angular distances along a circumference extending exteriorly around the portion of the bore 32 which passes through the muzzle 40 of the barrel 28.

The gases from the ignition of the cartridge charge will be expulsed rearwardly from the apertures 62, providing a plurality of exhaust jets, which will exert forward forces that urge the barrel extender 30 forward to prevent recoil. The speed of the gases will slow substantially within the rearward annular chamber 42, and then exit through the perforations 26, which extend laterally through the perforated barrel shroud 24. The expulsion of gases as jet-like streams passing through and from within the apertures 62 will prevent the forward end of the barrel 28 from moving rearward to reduce recoil, and increase the accuracy of the weapon 10 as it is operated in a rapid-fire mode.

Although the preferred embodiment has been described in detail, it should be understood that various changes, substitutions and alterations can be made therein without departing from the spirit and scope of the invention as defined by the appended claims.

What is claimed is:

1. A ballistic weapon from within which a ballistic projectile is propelled, the ballistic weapon comprising:

a frame:

a housing mounted to said frame, and enclosing a cartridge chamber;

a barrel mounted to said frame and said housing said barrel extending forward of said housing and having a bore extending longitudinally therethrough from a rearward end to a forward end of said barrel, said bore defining a longitudinal axis of said barrel which is centrally disposed within said bore;

said cartridge chamber, disposed at said rearward end of said barrel;

a barrel extender disposed at a forward end of said barrel, said barrel extender including an outer body portion, with an interior surface, and a rearward portion, said outer body and said rearward portion defining a forward chamber in communication with said bore of said barrel;

a shroud having an upper portion and a lower portion extending exteriorly about said barrel to define a rearward chamber which extends exteriorly about said barrel and within said shroud, wherein said rearward chamber is disposed rearward of said barrel extender and said forward chamber, with said upper portion of said shroud extending above said barrel and having perforations extending therethrough, and said lower portion of said shroud extending beneath said barrel and being substantially imperforate for enclosing said rearward chamber beneath said barrel;

said rearward portion of said barrel extender defining an aperture which extends between said forward and said rearward chambers for establishing communication therebetween, wherein gas is expulsed from said forward chamber, through said aperture and into said rearward chamber to prevent recoil of said weapon;

said perforations in said upper portion of said shroud extending between said rearward chamber and an exterior of said ballistic weapon for passing the gas from said rearward chamber to the exterior of said shroud and said ballistic weapon, and wherein said lower portion of said shroud is substantially impervious to the gas;

a rearward grip mounted to said frame beneath a rearward end of said housing:

a forward gap which extends downward from beneath said shroud; and wherein said ballistic weapon is hand-held and operable in a rapid-fire mode, such that a portion of hot gases from a charge of a cartridge which is disposed within said cartridge chamber and ignited are passed from said bore of said barrel and into said forward chamber, then rearward beneath said perforated shroud and exteriorly of said shroud.

2. The ballistic weapon according to claim 1, further comprising a rearward wall included within said rearward portion of said barrel extender and extending exteriorly around said forward portion of said barrel, wherein said aperture extends through said rearward wall, substantially parallel to said longitudinal axis of said barrel.

3. The ballistic weapon according to claim 1, wherein said aperture comprises a plurality of holes having central axes which extend substantially parallel to said longitudinal axis of said barrel.

4. The ballistic weapon according to claim 1, wherein said barrel extender further comprises a forward wall having a hole extending therethrough, said hole being coaxially aligned with the longitudinal axis of said bore of said barrel.

5. The ballistic weapon according to claim 1, wherein said rearward portion of said barrel extender further comprises a connector which extends rearwardly from a rearward wall for fitting exteriorly around said forward end of said barrel for securing said barrel extender thereto, with said aperture extending between said connector and said outer body portion of said barrel extender.

6. The ballistic weapon according to claim 1, wherein an exterior of said shroud fits flush with an outermost exterior surface of said outer body portion of said barrel extender.

7. The ballistic weapon according to claim 1, further comprising:

a rearward wall included within said rearward portion of said barrel extender and extending exteriorly around said forward portion of said barrel, wherein said aperture includes a plurality of holes which extend through said rearward wall, substantially parallel to said longitudinal axis of said barrel; and said rearward portion of said barrel extender further including a connector which extends rearwardly from said rearward wall for fitting exteriorly around said forward end of said barrel for securing said barrel extender thereto, with said holes extending between said connector and said outer body portion of said barrel extender.

8. The ballistic weapon according to claim 1, wherein the perforations through said shroud extend in directions which are transverse to said longitudinal axis of said barrel.

9. A ballistic weapon from within which a ballistic projectile is propelled, the ballistic weapon comprising:

a frame;

a housing mounted to said frame, and enclosing a cartridge chamber;

a barrel mounted to said frame and said housing, said barrel extending forward of said housing and having a bore extending longitudinally therethrough from a rearward end to a forward end of said barrel, said bore defining a longitudinal axis of said barrel which is centrally disposed within said bore;

said cartridge chamber, disposed at said rearward end of said barrel;

a barrel extender disposed on a forward end of said barrel, said barrel extender including an outer body portion, a forward portion and a rearward portion which together define a forward chamber;

said rearward portion of said barrel extender including a rearward wall with a connector portion for securing said barrel extender exteriorly around said forward end of said barrel, wherein said connector portion is spaced apart from said outer body portion and a plurality of apertures extend through said rearward wall between said outer body portion and said connector portion;

a shroud extending exteriorly about said barrel to define a rearward chamber disposed between said barrel and said shroud, rearward of said forward chamber, with said rearward chamber aligned rearward of and adjacent to said apertures through said rearward wall in communication with said forward chamber of said barrel extender;

wherein said shroud has perforations extending therethrough such that said rearward chamber is in communication with an exterior of said ballistic weapon in an upward direction, and said rearward chamber is substantially enclosed in a downward direction;

a rearward grip, mounted to said frame beneath a rearward end of said housing;

a forward grip which extends downward from beneath said shroud: and wherein said ballistic weapon is hand-held and operable in a rapid-fire mode, such that a portion of hot gases from a charge of a cartridge which is disposed within said cartridge chamber and ignited are passed from said bore of said barrel and into said forward chamber, then rearward beneath said perforated shroud and exteriorly of said perforated shroud.

10. The ballistic weapon according to claim 9, wherein said apertures through said rearward wall of said rearward portion of said barrel extender have central axes which are angularly spaced apart about and substantially parallel to said longitudinal axis of said central bore.

11. The ballistic weapon according to claim 9 wherein said apertures are angularly spaced apart equal distances around said longitudinal axis of said bore of said barrel.

12. The ballistic weapon according to claim 9, wherein said forward chamber has a cross-sectional area which is significantly larger than the cross-sectional area of said bore of said barrel.

13. The ballistic weapon according to claim 9, wherein an exterior of said outer body portion of said barrel extender fits flush with an exterior of said shroud.

14. The ballistic weapon according to claim 9, wherein:

said apertures through said rearward wall of said barrel extender have central axes which are angularly spaced equal distances apart about and extend substantially parallel to said longitudinal axis of said central bore of said barrel; and an exterior of said outer body portion of said barrel extender fits flush with an exterior of said shroud and an interior surface of said outer body portion defines said forward chamber such that said forward chamber has a cross-sectional area which is significantly larger than the cross-sectional area of said bore of said barrel.

15. The ballistic weapon according to claim 9, wherein said perforations extend through said shroud in a direction which is transverse to said longitudinal axis of said barrel.

16. A ballistic weapon from within which a ballistic projectile is propelled, the ballistic weapon comprising:

a frame, a housing mounted to said frame, and enclosing a cartridge chamber:

a barrel mounted to said frame and said housing said barrel extending forward of said housing and having a bore extending longitudinally therethrough from a rearward end to a forward end of said barrel, said bore defining a longitudinal axis of said barrel which is centrally disposed within said bore;

said cartridge chamber, disposed at said rearward end of said barrel;

a barrel extender disposed on a forward end of said barrel, said barrel extender including a cylindrical outer body portion, a forward ring-like portion and a rearward portion which together define a forward chamber;

said rearward portion of said barrel extender including a rearward annular wall with a tubular connector portion for securing said barrel extender to an exterior of said forward end of said barrel, wherein said tubular connector portion is spaced apart from said cylindrical outer body portion by said rearward annular wall and a plurality of apertures extend through said rearward annular wall, substantially parallel to said longitudinal axis of said bore of said barrel;

a perforated shroud extending exteriorly about said barrel to define a rearward chamber disposed between said barrel and said perforated shroud, rearward of said forward chamber, wherein said rearward chamber is aligned rearward of and adjacent to said apertures through said rearward annular wall and is in communication with said forward chamber of said barrel extender;

wherein said perforated shroud has perforations which extend therethrough in a transverse direction to said longitudinal axis of said bore of said barrel, such that said rearward chamber is in communication with an exterior of said ballistic weapon in an upwards direction, and wherein said rearward chamber is enclosed in a downward direction, a rearward grip mounted to said frame beneath a rearward end of said housing;

a forward grip which extends downward from beneath said perforated shroud; and wherein said ballistic weapon is hand-held and operable in a rapid-fire mode, such that hot gases from a charge of a cartridge which is disposed within said cartridge chamber and ignited are passed from said bore to said barrel and into said forward chamber, then rearward beneath said perforated shroud and exteriorly of said perforated shroud.

17. The ballistic weapon according to claim 16, wherein:

said apertures through said rearward annular wall of said barrel extender have central axes which are angularly spaced equal distances apart about said longitudinal axis of said barrel; and an exterior of said outer body portion of said barrel extender fits flush with an exterior of said perforated shroud and an interior surface of said outer body portion defines said forward chamber such that said forward chamber has a cross-sectional area which is significantly larger than the cross-sectional area of said bore of said barrel.

18. The ballistic weapon system according to claim 16, wherein said barrel is exteriorly tapered to narrow in a direction extending from said cartridge chamber toward said muzzle, such that cross-sectional areas through various sections of said rearward chamber are annular and increase in size with an inner surface taper defined by said barrel which is narrows in a direction extending toward said muzzle.

* * * * *